US006637119B2

(12) United States Patent
Russell et al.

(10) Patent No.: US 6,637,119 B2
(45) Date of Patent: Oct. 28, 2003

(54) SURVEYING OF BOREHOLES

(75) Inventors: Michael Russell, Cheltenham (GB); Anthony William Russell, Turriff (GB)

(73) Assignee: Smart Stabilizer Systems Limited, Cheltenham (GB)

( * ) Notice: Subject to any disclaimer, the term of this patent is extended or adjusted under 35 U.S.C. 154(b) by 0 days.

(21) Appl. No.: 10/072,129

(22) Filed: Feb. 5, 2002

(65) Prior Publication Data

US 2002/0144417 A1 Oct. 10, 2002

(30) Foreign Application Priority Data

Feb. 6, 2001 (GB) ..... 0102900

(51) Int. Cl.[7] ..... E21B 47/22
(52) U.S. Cl. ..... 33/304
(58) Field of Search ..... 33/302, 303, 304

(56) References Cited

U.S. PATENT DOCUMENTS 4,510,696 A * 4/1985 Roesler ..... 33/304
4,682,421 A 7/1987 van Dongen et al.
4,819,336 A * 4/1989 Russell ..... 33/304
4,999,920 A * 3/1991 Russell et al. ..... 33/304
5,314,030 A * 5/1994 Peterson et al. ..... 33/304
5,398,421 A 3/1995 Nicolle et al.
5,435,069 A * 7/1995 Nicholson ..... 33/304
5,469,736 A * 11/1995 Moake ..... 33/302
5,606,124 A * 2/1997 Doyle et al. ..... 33/304
5,646,611 A * 7/1997 Dailey et al. ..... 33/304
6,065,218 A * 5/2000 Edwards ..... 33/303

FOREIGN PATENT DOCUMENTS

EP 0387991 A2 9/1990
WO WO 99/66173 A1 12/1999

OTHER PUBLICATIONS

Alison Bourne, The UK Patent Office, Patents Act 1977 Search Report under Section 17, Aug. 23, 2002, UK (one page).

* cited by examiner

*Primary Examiner*—G. Bradley Bennett
(74) *Attorney, Agent, or Firm*—Mark A. Oathout

(57) ABSTRACT

A borehole drilling and survey assembly includes a drill string of magnetic material, a non-magnetic drill collar, and a non-magnetic rotary drilling system including a drill bit. A near-bit survey instrument is located in the rotary drilling system at a fixed distance from the junction of the drill string and the drill collar. A second survey instrument is located in the drill collar at a fixed distance from said junction. The survey instruments measure the local values of the component of the earth's magnetic along the borehole axis, and these values are processed to remove the magnetic effects of the drillstring. The survey instruments optionally also measure gravity vector components to enable borehole heading to be derived.

7 Claims, 3 Drawing Sheets

SURVEYING OF BOREHOLES

Figure 1:
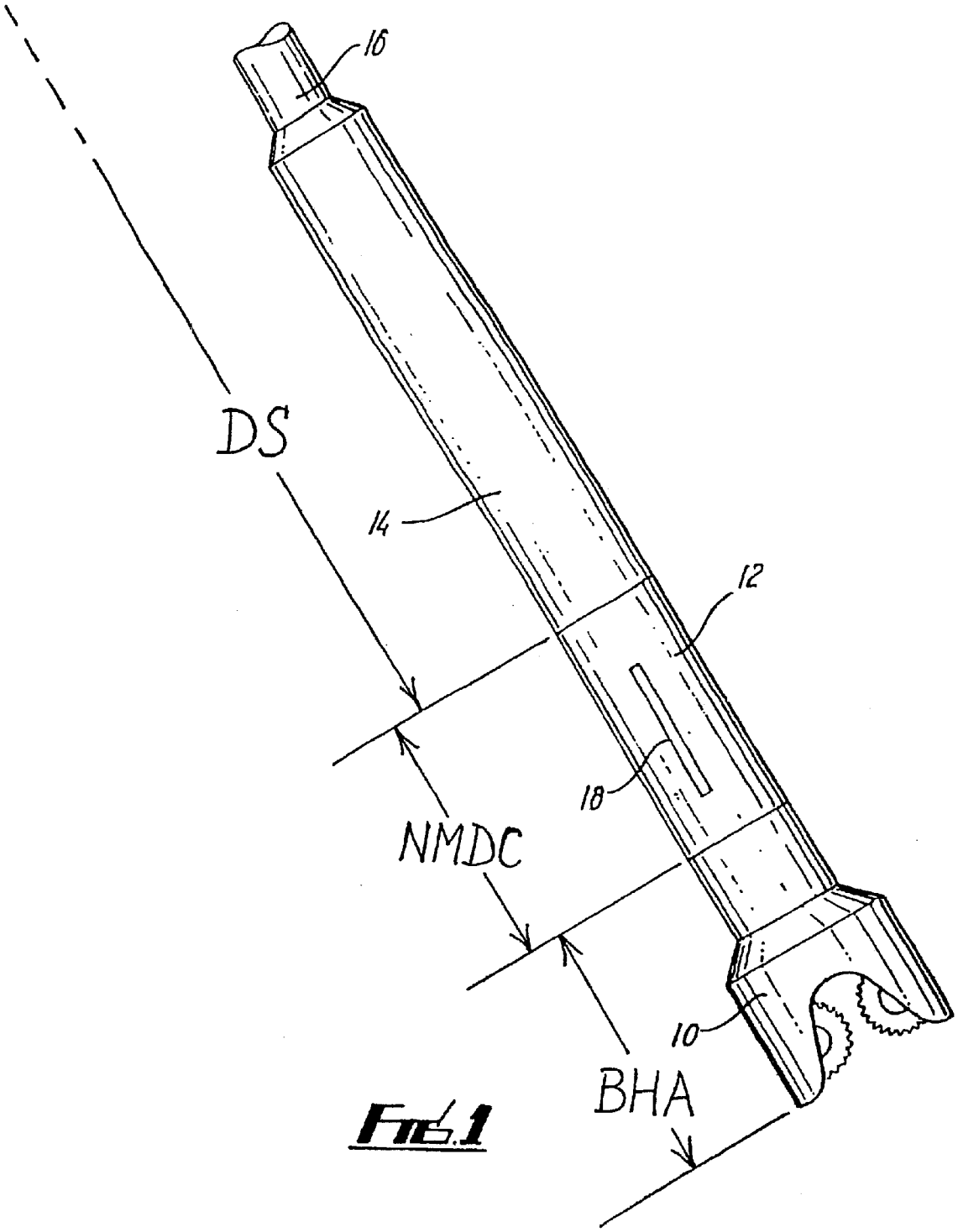

This application claims the right of priority of application number 0102900.8, filed in the United Kingdom (UK) on Feb. 6, 2001.

This invention relates to the surveying of boreholes, and relates more particularly but not exclusively to determining the true azimuth of a borehole.

When drilling a well for exploration and recovery of oil or gas, it is known to drill a deviated well, which is a well whose borehole intentionally departs from vertical by a significant extent over at least part of its depth. When a single drilling rig is offshore, a cluster of deviated wells drilled from that rig allows a wider area and a bigger volume to be tapped from the single drilling rig at one time and without expensive and time-consuming relocation of the rig than by utilising only undeviated wells. Deviated wells also allow obstructions to be by-passed during drilling, by suitable control of the deviation of the borehole as it is drilled. However, to obtain the full potential benefits of well deviation requires precise knowledge of the instantaneous location and heading of the bottom-hole assembly (including the drilling bit and steering mechanisms such as adjustable stabilisers). Depth of the bottom-hole assembly (or axial length of the borehole) can be determined from the surface, for example by counting the number of standard-length tubulars coupled into the drill string, or by less empirical procedures. However, determination of the location and heading of the bottom-hole assembly generally requires some form of downhole measurement of heading. Integration of heading with respect to axial length of the borehole will give the borehole location relative to the drilling rig.

In this context, the word "heading" is being used to denote the direction in which the bottom-hole assembly is pointing (ie. has its longitudinal axis aligned), both in a horizontal and vertical sense. Over any length of the borehole which can be considered as straight for the purposes of directional analysis, the borehole axis in a deviated well will have a certain inclination with respect to true vertical. A vertical plane including this nominally straight length of borehole will have a certain angle (measured in a horizontal plane) with respect to a vertical plane including a standard direction; this standard direction is hereafter taken to be true magnetic north, and the said angle is the magnetic azimuth of the length of the borehole under consideration (hereafter simply referred to as "azimuth"). The combination of inclination and azimuth at any point down the borehole is the heading of the borehole at that point; borehole heading can vary with depth as might be the case, for example, when drilling around an obstacle.

Instrumentation packages are known, which can be incorporated into bottom-hole assemblies to measure gravity and magnetism in a number of orthogonal directions related to the heading of the bottomhole assembly. Mathematical manipulations of undistorted measurements of gravitational and magnetic vectors can produce results which are representative of the true heading at the point at which the readings were taken. However, the measurements of magnetic vectors are susceptible to distortion, not least because of the masses of ferrous materials incorporated in the drill string and bottom-hole assembly. Distortion of one or more magnetic vector measurements can give rise to unacceptable errors in the determination of heading, and undesirable consequences. Distortion of magnetic vectors in the region of the instrumentation arising from inherent magnetism of conventional drill string and bottom-hole assembly components can be mitigated by locating the instrumentation in a special section of drill string which is fabricated of non-magnetic alloy. However, such special non-magnetic drill string sections are relatively expensive. Moreover, the length of non-magnetic section required to bring magnetic distortion down to an acceptable level increases significantly with increased mass of magnetic bottom-hole assembly and drill string components, with consequent high cost in wells which use such heavier equipment, e.g. wells which are longer and/or deeper. Hence such forms of passive error correction may be economically unacceptable. Active error correction by the mathematical manipulation of vector readings which are assumed to be error-free or to have errors which are small may give unreliable results if the assumption is unwarranted.

Figure 2:
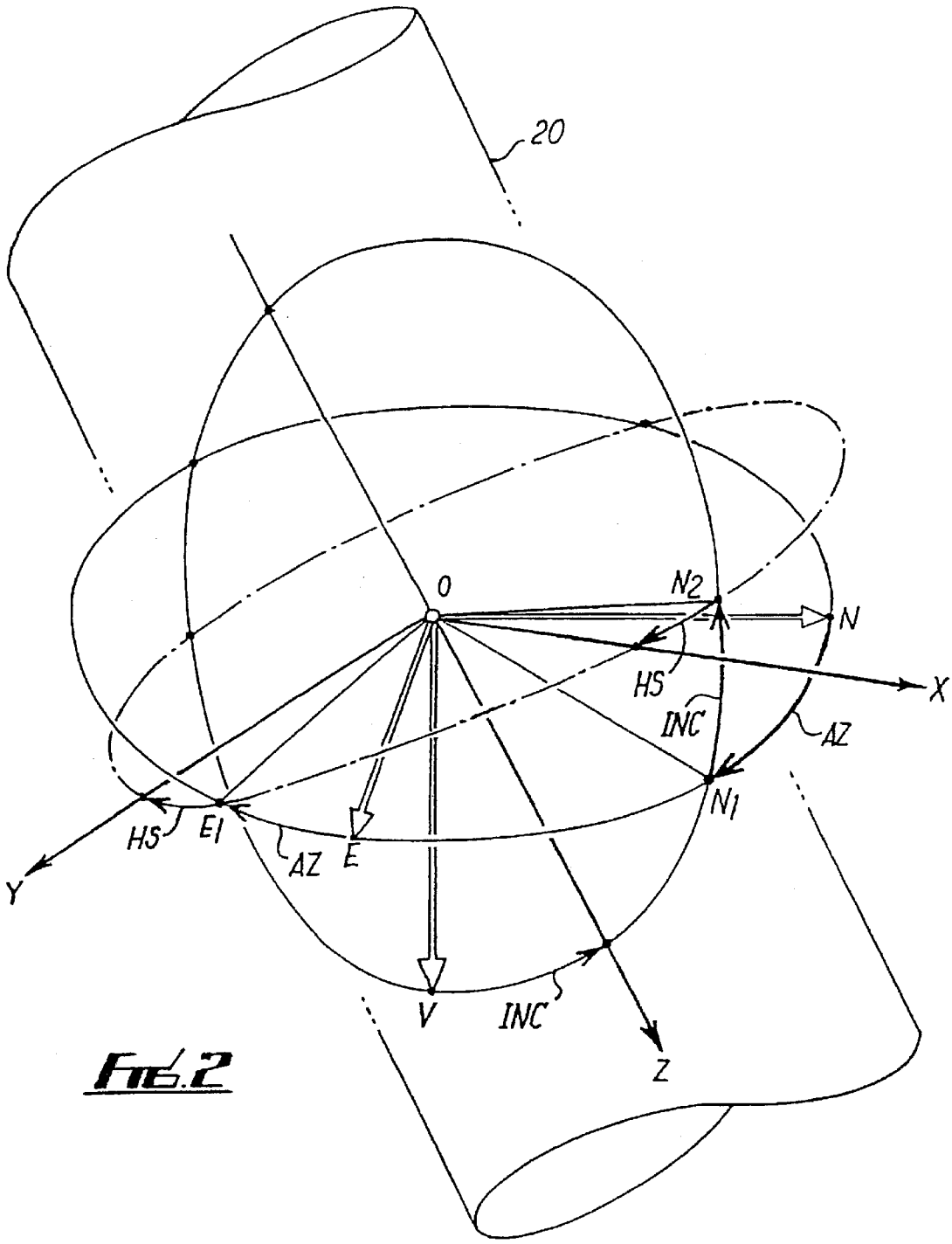

Before describing the invention, several definitions will be detailed with reference to FIGS. 1 and 2 of the accompanying drawings, wherein:

FIG. 1 is a schematic elevational view of the bottom-hole assembly of a drill string; and FIG. 2 is a schematic perspective view of various axes utilised for denoting directions in three dimensions.

Referring first to FIG. 1, the bottom-hole assembly of a drill string comprises a drilling bit 10 coupled by a non-magnetic drill collar 12 and a set of drill collars 14 to a drill pipe 16. The drill collars 14 may be fabricated of a magnetic material, but the drill collar 12 is substantially devoid of any self-magnetism.

During local gravity and magnetic field vector measurements, the non-magnetic drill collar 12 houses a downhole instrumentation package schematically depicted at 18. (In reality, the package 18 would not be visible as is apparently the case in FIG. 1 since the package 18 is utilised within the interior of the collar 12). The downhole instrumentation package 18 is capable of measuring gravity vectors and local magnetic vectors, for example by the use of accelerometers and fluxgates respectively. The instrumentation package 18 may be axially and rotationally fixed with respect to the bottom-hole assembly, including the drilling bit 10, whose heading is to be determined; the instrumentation package 18 would then be rigidly mounted in the bottom-hole assembly, within the non-magnetic drill collar 12 which is fabricated of non-magnetic alloy. Alternatively, the package 18 could be lowered through the collar 12, either on a wireline or as a free-falling package, with internal recording of the local gravity vectors and the local magnetic vectors. The alternative procedures for measurement processing according to whether the instrumentation package 18 is axially fixed or mobile will be subsequently described.

Referring now to FIG. 2 for convenience of conceptual presentation and calculation references, a hypothetical origin or omni-axial zero point "0" is deemed to exist in the centre of the instrumentation package 18 (not shown in FIG. 2). Of the three orthogonal axes OX, OY and OZ defining the alignment of the instrumentation relative to the bottom-hole assembly, the OZ axis lies along the axis of the bottom-hole assembly, in a direction towards the bottom of the assembly and the bottom of a borehole 20 drilled by the drilling bit 10. The OX and OY axes, which are orthogonal to the OZ axis and therefore lie in a plane 0.N2.E1 (now defined as the "Z-plane") at right angles to the bottom-hole assembly axis OZ, are fixed with respect to the body (including the collar 12) of the bottom-hole assembly. As viewed from above, the OX axis is the first of the fixed axes which lies clockwise of the upper edge of the (inclined) bottom-hole assembly, this upper edge lying in the true azimuth plane 0.N2.N1.V of the bottom-hole assembly. The angle N2.0.X. in the Z-plane 0.N2.E1 (at right angles to OZ axis) between the bottom-hole assembly azimuth plane 0.N2.N1.V and the ox axis is the highside angle "HS". The OY axis lies in the Z-plane 0.N2.E1 at right angles to the OX axis in a clockwise direction as viewed from above. A gravity vector-measuring accelerometer (or other suitable device) is fixedly aligned with each of the OX, OY and OZ axes. A magnetic vector-measuring fluxgate (or other suitable device) is fixedly aligned in each of the OX, OY and OZ axes. The instrumentation package 18 may be energised by any suitable known arrangement, and the instrumentation readings may be telemetered directly or in coded form to a surface installation (normally the drilling rig) by any suitable known method, or alternatively the instrumentation package 18 may incorporate computation means to process instrumentation readings and transmit computational results as distinct from raw data, or the instrumentation package 18 may incorporate recording means for internal recording of the local axial magnetic vectors for subsequent retrieval of the package 18 and on-surface processing of the recorded measurements.

Also notionally vectored from the origin O are a true vertical (downwards) axis OV, a horizontal axis ON pointing horizontally to true Magnetic North, and an OE axis orthogonal to the OV and ON axes, the OE axis being at right angles clockwise in the horizontal plane as viewed from above (ie. the OE axis is a notional East-pointing axis).

The vertical plane O.N2.N1.V including the OZ axis and OV axis is the azimuth plane of the bottom-hole assembly. The angle V.O.Z. between the OV axis and the OZ axis, ie. the angle in the bottom-hole assembly azimuth plane O.N2.N1.V, is the bottom-hole assembly inclination angle "INC" which is the true deviation of the longitudinal axis of the bottom-hole assembly from vertical. Since the angles V.O.N1 and Z.O.N2 are both right angles and also lie in a common plane (the azimuth plane O.N2.N1.V), it follows that the angle N1.O.N2 equals the angle V.O.Z, and hence the angle N1.O.N2 also equals the angle "INC".

The vertical plane O.N.V including the OV axis and the ON axis is the reference azimuth plane or true Magnetic North. The angle N.O.N1 measured in a horizontal plane O.N.N1.E.E1 between the reference azimuth plane O.N.V. (including the OV axis and the ON axis) and the bottom-hole assembly azimuth plane O.N2.N1.V (including the OV axis and the OZ axis) is the bottom-hole assembly azimuth angle "AZ".

The OX axis of the instrumentation package is related to the true Magnetic North axis ON by the vector sum of three angles as follows:

(1) horizontally from the ON axis round Eastwards (clockwise as viewed from above) to a horizontal axis O.N1 in the bottom-hole assembly azimuth plane O.N2.N1.V by the azimuth angle AZ (measured about the origin O in the horizontal plane);

(2) vertically upwards from the horizontal axis O.N1 in the azimuth plane O.N2.N1.V to an inclined axis O.N2 in the Z-plane (the inclined plane O.N2.E1 including the OX axis and the OY axis) by the inclination angle INC (measured about the origin O in a vertical plane including the origin O); and (3) a further angle clockwise/Eastwards (as defined above) in the Z-plane from the azimuth plane to the OX axis by the highside angle HS (measured about the origin O in the inclined Z-plane O.N2.E1 which includes the origin O).

Borehole surveying instruments measure the two traditional attitude angles, inclination and azimuth, at points along the path of the borehole. The inclination at such a point is the angle between the instrument longitudinal axis and the Earth's gravity vector direction (vertical) when the instrument longitudinal axis is aligned with the borehole path at that point. Azimuth is the angle between the vertical plane which contains the instrument longitudinal axis and a vertical reference plane which may be either magnetically or gyroscopically defined; this invention is concerned with the measurement of azimuth defined by a vertical reference plane containing a defined magnetic field vector.

Inclination and azimuth (magnetic) are conventionally determined from instruments which measure the local gravity and magnetic field components along the directions of the orthogonal set of instrument-fixed axes (OX,OY,OZ); traditionally, OZ is the instrument longitudinal axis. Thus, inclination and azimuth are determined as functions of the elements of the measurement set (GX,GY,GZ,BX,BY,BZ), where GX is the magnitude of the gravity vector component in direction OX,BX is the magnitude of the magnetic vector component in direction OX, etc. The calculations necessary to derive inclination and azimuth as functions of GX,GY, GZ,BX,BY,BZ are well known.

When the vertical magnetic reference plane is defined as containing the local magnetic field vector at the instrument location, the corresponding azimuth angle is known as the raw azimuth; if the vertical magnetic reference plane is defined as containing the Earth's magnetic field vector at the instrument location, the corresponding azimuth angle is known as absolute azimuth.

In practice, the value of the absolute azimuth is required and two methods to obtain it are presently employed:

(i) The instrumentation package is contained within a non-magnetic drill collar (NMDC) which is sufficiently long to isolate the instrument from magnetic effects caused by the proximity of the drill string (DS) above the instrument and the stabilizers, bit, etc. forming the bottom-hole assembly (BHA) below the instrument. In this case the Earth's magnetic field is uncorrupted by the DS and BHA and the raw azimuth measured is equal to the absolute azimuth.

(ii) The corrupting magnetic effect of the DS and BHA is considered as an error vector along direction OZ thereby leaving BX and BY uncorrupted (components only of the Earth's magnetic field). The calculation of the absolute azimuth can then be performed as a function of GX,GY,GZ,BX,BY,Be, where Be is some value (or combination of values) associated with the Earth's magnetic field.

The error in the measurement of absolute azimuth by method (ii) is dependent on the attitude of the instrument and may greatly exceed the error in the measurement of the raw azimuth; the reasons for this are summarised as follows:

(iii) the need to know the values of Earth's magnetic field components in instrument-magnetic-units to a high degree of accuracy:

(iv) an inherent calculation error due to the availability of only the uncorrupted cross-axis (BOXY) magnetic vector component. [This is analogous to measuring only the gravity component GZ and then attempting to determine the inclination (INC) from INC=ACOS (GZ), with the magnitude of Earth's gravity=1 instrument gravity-unit].

The foregoing text and FIGS. 1 and 2 were extracted from the introduction to GB2229273A, which represents the state of the art over which the present invention is an improved method of surveying of boreholes, as will be detailed below.

Recent developments of long-reach directional rotary drilling systems make it desirable to be able to perform accurate near-bit survey measurements. While it is possible to make the relatively short bottom-hole drilling system (comprising the drill bit, downhole drill motor, and possibly also an adjustable stabiliser) substantially non-magnetic, the corruption of magnetic field measurements in a near-bit survey instrument package can only be eliminated by the use of long non-magnetic drill collars, or through the use of calculation correction methods which require measurements of absolute magnetic fields (as described in GB2229237A) and are unsatisfactory for some drilling directions at high inclinations.

The present invention allows the accurate measurement of azimuth at a near-bit location in a bottom-hole assembly using only a standard-length non-magnetic drill collar (ie. a non-magnetic drill collar with a standard length of 30 meters).

According to a first aspect of the present invention there is provided a method of surveying the magnetic azimuth of a borehole penetrated by a bottom-hole assembly comprising a magnetic drill string attached to one end of a substantially non-magnetic drill collar to the other end of which is attached a substantially non-magnetic drilling bit assembly, by deriving the true magnitude of the terrestrial magnetic field BZe in the direction of the longitudinal axis OZ of the borehole in the region of the substantially non-magnetic drill collar, said method comprising the steps of measuring the longitudinal magnetic field BZ(a) (the component of the magnetic field B in the direction OZ) at a single predetermined point along the length of the substantially non-magnetic drill collar, and measuring the longitudinal magnetic field BZ(b) at a single predetermined point along the length of the substantially non-magnetic drilling bit assembly, to provide a longitudinal-position-dependent pair of longitudinal magnetic field measurements BZ(z), and calculating BZe on the basis that BZ(z)=BZe+E(z), where E(z) is the longitudinal-position-dependent longitudinal magnetic field error induced by magnetism of the drill string on the assumption that the longitudinal magnetic field error E(z) is induced by a single notional magnetic pole in the magnetic drill string substantially at the attachment of the magnetic drill string to the substantially non-magnetic drill collar.

The foregoing magnetic azimuth surveying method may optionally be extended to include the measurement of gravity vector components Gx, Gy and Gz and solving the function [Gx,Gy,Gz,Bx,By,BZe] to determine the borehole heading.

Other aspects of the present invention provide apparatus for use in the foregoing method, and borehole drilling and surveying equipment incorporating such apparatus.

Embodiments of the invention will now be described by way of example, with reference to FIG. 3 of the accompanying drawings, which is a schematic diagram of a bottom-hole assembly to which the invention is applied.

Figure 3:
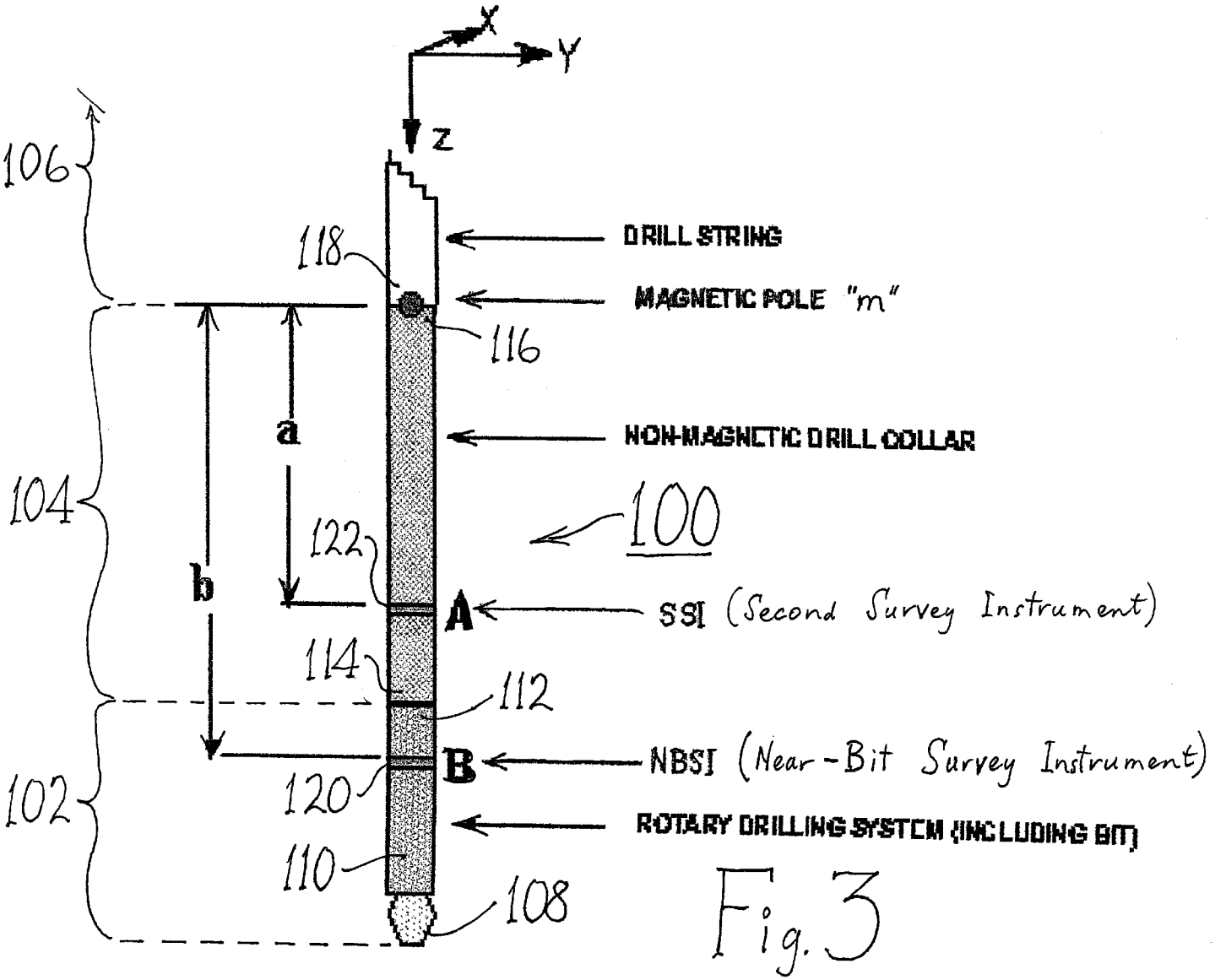

Referring to FIG. 3, a bottom-hole assembly 100 comprises a drilling bit assembly 102, a non-magnetic drill collar 104, and a drill string 106.

The drilling bit assembly 102 comprises a drilling bit 108 and a downhole drilling motor 110. The assembly 102 is fabricated of non-magnetic materials, and is therefore substantially free of self-magnetism. A direction-controlling stabiliser (not shown) which is also free of self-magnetism may be incorporated in the drilling bit assembly 102 in order to control the directional tendency of further extensions of the borehole (not depicted per se) drilled by the drilling bit 108, such directional tendency being normally controlled or influenced by the results of borehole surveying in conjunction with intended borehole targets (with possible directional modifications to mitigate unexpected problems).

The non-magnetic drill collar 104 is a standard component known per se, being fabricated of non-magnetic materials and having a standard length of ten meters.

The drill string 106 is a standard assembly of hollow tubular steel pipes interconnected by tapered screw-thread connections to form a mechanical and hydraulic link with a drilling rig (not shown) on the surface of land or sea above the borehole. Since the drill string 106 is fabricated mainly or wholly of ferrous materials, it has self-magnetism which corrupts at least the longitudinal component of magnetic field measurements performed in the bottom-hole assembly 100 near the drilling bit 108.

The upper end 112 of the drilling bit assembly 102 is attached to the lower end 114 of the non-magnetic drill collar 104. The upper end 116 of the non-magnetic drill collar 104 is attached to the lower end 118 of the drill string 106.

For the purpose of near-bit borehole azimuth surveying in accordance with the invention, the bottom-hole assembly 100 is fitted at mutually spaced-apart locations with two separate survey instruments, as will now be detailed.

A near-bit survey instrument ("NBSI") 120 is fitted within the substantially non-magnetic drilling bit assembly 102 at a location (designated "B") which is at a known fixed distance "b" below the lower end 118 of the drill string 106. (The term "below" is used to indicate that the location "B" is closer to the drilling bit 108 and hence further along the borehole from the surface than the lower end 118 of the drill string 106 notwithstanding that the borehole may have deviated so far from an initially vertically downwards direction at the surface that the borehole is now horizontal or even headed upwards).

A second survey instrument ("SSI") 122 is fitted within the non-magnetic drill collar 104 at a location (designated "A") which is at a known fixed distance "a" below the lower end 118 of the drill string 106. (The term "below" is again used to indicate that the location "A" is closer to the drilling bit 108 and hence further along the borehole from the surface than the lower end 118 of the drill string 106, in the same way that "below" was used in respect of location "B" as detailed above).

The borehole surveying method in accordance with the invention is based on the assumption that the magnetic survey-corrupting effects of the drill string 106 can be represented by a single notional magnetic pole of longitudinal magnetic strength "m" and which is located at the lower end 118 of the drill string 106. Details of the method of the invention, as based on this assumption, will now be given.

If the NBSI 120 and the SSI 122 each contain conventional 3-orthogonal-axes gravity (G) and magnetic (B) transducers then for this configuration, the measured parameters set for the NBSI 120 at position A can be defined by:—

$$\{GXa,GYa,GZa,BXa,BYa,BZa\}=\{GX,GY,GZ,BX,BY,BZa\}$$

and that for the SSI 122 at position B by:

$$\{GXb,GYb,Gzb,BXb,BYb,BZb\}=\{GX,GY,GZ,BX,BY,BZb\}$$

In terms of the conventional Highside, Inclination and Azimuth surveying angles, the corresponding survey parameter sets are defined by:—

$$\{HS,INC,AZa\} \text{ and } \{HS,INC,AZb\}$$

Conventional derivations for the Azimuth Angle (AZ) lead to calculations of AZa and AZb from—:

$$\sin(AZa)/\cos(AZa)=K1/(K2*BZa+K3)$$

and $$\sin(AZb)/\cos(AZb)=K1/(K2*BZb+K3)$$

where K1, K2, and K3 are functions of only INC, HS, BX, and BY.

The corrected azimuth AZc is given by:—

$$\sin(AZc)/\cos(AZc)=K1/(K2*BZ+K3)$$

where BZ=BZa−Ea=BZb−Eb with $Ea=m/a^2$=the magnetic error at A due to pole m and $Eb=m/b^2$=the magnetic error at B due to pole m

| | | |
|---|---|---|
| Thus, | K2*BZ + K3 = | K1*cot (AZc) |
| | K2*BZ + K3 + K2*Ea = | K1*cot (AZa) |
| | K2*BZ + K3 + K2*Eb = | K1*cot (AZb) |

which yield:—

$$Ea=(K1/K2)*[\cot(AZa)-\cot(AZc)]=m/a^2$$

and $$Eb=(K1/K2)*[\cot(AZb)-\cot(AZc)]=m/b^2$$

Therefore:—

$$a^2*[\cot(AZa)-\cot(AZc)]=b^2*[\cot(AZb)-\cot(AZc)]$$

or $$\cot(AZc)*(b^2-a^2)=b^2*\cot(AZb)-a^2*\cot(AZa)$$

Thus it can be shown that the corrected azimuth AZc can be derived from (for example)

$$\sin(AZc)/\cos(AZc)=(b^2-a^2)*\sin(AZa)*\sin(AZb)/[b^2*\sin(AZa)*\cos(AZb)-a^2*\sin(AZb)*\cos(AZa)]$$

or from other equivalent functions of a, b, AZa, and AZb alone.

Modifications and variations of the above-described surveying method, and of the instrumentation therefor, can be adopted without departing from the scope of the invention. For example, the survey instruments 120 and 122 could be simplified to measure only the longitudinal (Z-axis) magnetic fields at their respective locations "B" and "A", with other instrumentation being utilised to measure one or more of the omitted parameters if such measurements are deemed necessary or desirable.

Another possible, although less practicable, modification is to replace the two magnetic sensors at fixed locations with a single sensor which is transferred or reciprocated between these two locations, with the magnetic field at each being sampled for further processing. This would result in two non-simultaneous readings, but the time difference would not be significant to the method of the invention provided it is small in relation to movement of the drill string.

Other modifications and variations can be adopted without departing from the scope of the invention as defined in the claims.

What is claimed is:

1. Apparatus for surveying the magnetic azimuth of a borehole penetrated by a bottom-hole assembly comprising a magnetic drill string attached to one end of a substantially non-magnetic drilling bit assembly, said apparatus comprising magnetic field measuring means for measuring the longitudinal magnetic field BZ(a) at a first predetermined point which is along the length of the substantially non-magnetic drill collar, and for measuring the longitudinal magnetic field BZ(b) at a second predetermined point which is along the length of the substantially non-magnetic drilling bit assembly, to provide a longitudinal-position-dependent pair of longitudinal magnetic field measurements BZ(z).

2. Apparatus according to claim 1, in which said magnetic field measuring means comprises first magnetic field measuring means for mounting at a single fixed point on said drill collar, and second magnetic field measuring means for mounting at a single fixed point on said drilling bit assembly.

3. Apparatus according to claim 2, said apparatus further including:

third magnetic field measuring means for measuring the magnetic fields Bx and By in two mutually orthogonal axes each also orthogonal to the longitudinal axis; and gravity vector component measuring means for measuring gravity vector components in each of said three axes to produce respective gravity vector measurements Gx, Gy and Gz.

4. Apparatus according to claim 3, further comprising solving means constructed or adapted to solving the function to determine said heading.

5. Equipment for drilling a borehole and for surveying said borehole, said equipment comprising the operative combination of a substantially non-magnetic drill collar, a substantially non-magnetic drilling bit assembly, and apparatus according to claim 1.

6. Equipment for drilling a borehole and for surveying said borehole, said equipment comprising the operative combination of a substantially non-magnetic drill collar, a substantially non-magnetic drilling bit assembly, and apparatus according to claim 3.

7. A method of surveying the magnetic azimuth of a borehole penetrated by a bottom-hole assembly which comprises a magnetic drill string attached to one end of a substantially non-magnetic drill collar to the other end of which is attached a substantially non-magnetic drilling bit assembly; said method comprising the steps of:

measuring the longitudinal magnetic field BZ(a), where longitudinal magnetic field is defined as the component of the magnetic field B in the direction of the longitudinal axis of the borehole in the region of the substantially non-magnetic drill collar, at a first predetermined point which is along the length of the substantially non-magnetic drill collar;

measuring the longitudinal magnetic field BZ(b) at a second predetermined point which is along the length of the substantially non-magnetic drilling bit assembly, thereby providing a longitudinal-position-dependent pair of longitudinal magnetic filed measurements BZ(z);

and, on the assumption that the longitudinal magnetic field error E(z) is induced by a single notional magnetic pole in the magnetic drill string substantially at the attachment of the magnetic drill string to the substantially non-magnetic drill collar, calculating the corrected magnetic azimuth AZc from the relationship:

$$\cot(AZc)*(b^2-a^2)=b^2\cot(AZb)-a^2\cot(AZa)$$

where AZa is the uncorrected azimuth at said first predetermined point, AZb is the uncorrected azimuth at said second predetermined point, a is the distance between the first predetermined point and said notional magnetic pole, and b is the distance between the second predetermined point and said notional magnetic pole.

* * * * *

UNITED STATES PATENT AND TRADEMARK OFFICE

CERTIFICATE OF CORRECTION

PATENT NO. : 6,637,119 B2 
DATED : October 28, 2003
INVENTOR(S) : Michael Russell and Anthony William Russell It is certified that error appears in the above-identified patent and that said Letters Patent is hereby corrected as shown below:

Column 8,
Line 21, after "solving the function" insert -- [Gx,Gy,Gz,Bx,By,Bz] --.

Signed and Sealed this

Third Day of August, 2004

JON W. DUDAS
*Acting Director of the United States Patent and Trademark Office*